US007758266B2

(12) United States Patent
McLaughlin

(10) Patent No.: US 7,758,266 B2
(45) Date of Patent: Jul. 20, 2010

(54) ACCESSORY FOR A WRITING IMPLEMENT OR THE LIKE

(76) Inventor: Timothy Francis McLaughlin, Kangaroo Point (AU); Francis Patrick McLaughlin, legal representative, Unit 84, 2 Goodwin Street, Kangaroo Point, QLD (AU) 4169

( * ) Notice: Subject to any disclaimer, the term of this patent is extended or adjusted under 35 U.S.C. 154(b) by 0 days.

(21) Appl. No.: 10/482,533

(22) PCT Filed: Jun. 21, 2002

(86) PCT No.: PCT/AU02/00807

§ 371 (c)(1),
(2), (4) Date: Dec. 22, 2003

(87) PCT Pub. No.: WO03/000507

PCT Pub. Date: Jan. 3, 2003

(65) Prior Publication Data

US 2004/0213623 A1 Oct. 28, 2004

(30) Foreign Application Priority Data

Jun. 21, 2001 (AU) ..... PR5865

(51) Int. Cl.
*A46B 11/00* (2006.01)
*A46B 17/02* (2006.01)

(52) U.S. Cl. ..... 401/48; 401/88

(58) Field of Classification Search ..... 401/48, 401/88, 92, 93, 95, 98, 131, 6
See application file for complete search history.

(56) References Cited

U.S. PATENT DOCUMENTS 1,704,772 A * 3/1929 Spikins ..... 401/88
1,815,451 A 7/1931 Schneider
1,936,213 A 11/1933 Snedden
2,049,810 A 8/1936 Kusa
2,056,384 A 10/1936 Brandon
2,759,453 A 8/1956 De Baun
2,907,301 A 10/1959 Spatz
2,968,849 A * 1/1961 Cain ..... 401/88
4,522,522 A 6/1985 Zeitelhack
5,292,202 A 3/1994 Lee (Continued)

FOREIGN PATENT DOCUMENTS

DE 19645847 A1 6/1997

(Continued)

OTHER PUBLICATIONS

Derwent Abstract Accession No. 91-206564/28, Class P77, SU 1588565 A, Aug. 30, 1990.

(Continued)

*Primary Examiner*—Tuan N Nguyen

(57) ABSTRACT

There is provided an accessory for a writing implement including a body assembly comprising a barrel and a split plug and defining a passage therethrough adapted to receive a pencil. The barrel is provided with an internally threaded end adapted to be engaged by an outer threaded portion of the split plug which is provided with a pair of opposed slots. The respective threaded portions are relatively tapered whereby threaded engagement of the split plug with the barrel causes the slots to close up such that the pencil is retained thereby. The barrel is provided with a pocket clip.

8 Claims, 7 Drawing Sheets

U.S. PATENT DOCUMENTS

| | | | | |
|---|---|---|---|---|
| 5,868,509 | A | 2/1999 | Crutcher | |
| 6,095,706 | A * | 8/2000 | Hashimoto et al. | 401/99 |
| 6,149,332 | A * | 11/2000 | Huang | 401/88 |
| 6,276,854 | B1 * | 8/2001 | Mullins | 401/88 |
| 6,322,267 | B1 * | 11/2001 | Shaffer-Bauck | 401/88 |
| 6,386,777 | B1 | 5/2002 | Lee | |

FOREIGN PATENT DOCUMENTS

| | | | |
|---|---|---|---|
| EP | 1219468 | A1 | 7/2002 |
| GB | 568846 | | 4/1945 |
| GB | 2140747 | A | 12/1984 |
| GB | 2200597 | | 8/1988 |
| GB | 2236282 | A | 4/1991 |
| GB | 2322598 | A | 9/1998 |
| JP | S285512 | B1 | 6/1953 |
| JP | S30-17006 | B1 | 12/1955 |

OTHER PUBLICATIONS

Derwent Abstract Accession No. E5931 D/20, Class P77, SU 761302 A, Sep. 30, 1980.
Japan Patent Office, Office Action Apr. 24, 2007.
Japan Patent Office Action Summary of Reasons.

* cited by examiner

ACCESSORY FOR A WRITING IMPLEMENT OR THE LIKE

FIELD OF THE INVENTION

This invention relates to an accessory for a writing implement.

This invention has particular but not exclusive application to a holder accessory for a pencil, and for illustrative purposes reference will be made to such application. However, it is to be understood that this invention could be used in other applications, such as ball-point and other pens, hand held scribing and cutting implements and the like.

BACKGROUND OF THE INVENTION

Mass-produced wooden pencils are cheap and may readily be sharpened by simple pencil sharpeners. Such pencils are generally round or hexagonal in section and for the most part are manufactured to a standard size for whichever of these shapes.

When a pencil is sharpened, the length is shortened, and continuing sharpening may result in the pencil becoming too short to comfortably hold for use. Some people are unable to use a pencil so compromised, and others will avoid the use of them, or discard them before their time.

BRIEF DESCRIPTION OF THE INVENTION

This invention in one aspect resides broadly in an accessory for a writing implement including:

a tubular body having a passage adapted to axially receive a writing implement therethrough; and retaining means associated with said body and disposed toward the writing point of a writing implement therein and adapted to selectively retain the writing implement in axial location within said passage, whereby in use the accessory and retained writing implement may be held in a writing position by a user.

The body may take any suitable form. Writing implements such as pens and propelling pencils may be constructed having a contoured gripping portion, whereas it is impractical to manufacture pencils thus. It Is accordingly preferred to provide at least part of the outer surface of the body with a griping surface. The griping surface may be of any suitable design which can facilitate a user's grip on the body and/or facilitate user comfort during use. The gripping surface may be textured and/or contoured. Alternatively or in addition to the gripping surface may be formed from a resilient material such as a resilient plastics material.

The body may be of any suitable length. The body may advantageously be of plastic or metal material. Typically, the body is formed from a thermoplastics material such as a polyolefin. Preferably the length of the body ranges from a minimum length for comfortable holding of the retained writing implement in use, up to about the length of a standard pencil. Typical lengths range between about 100 to about 170 mm.

The passage may comprise a bore through the body or may comprise a space within the body bounded by an entry and an exit. At least part of the bore is of a shape which is complimentary to the outer surface of the writing implement to be retained. For example, the bore may be of round section to accommodate round writing implements of relatively standard dimension, or may be shaped such as hexagonally in section to accommodate writing implements of that section.

In a yet further alternative, the passage may be provided with a shape whereby both round and hexagonal writing implements may pass.

The accessory Includes retaining means disposed towards the writing end of a writing implement and is adapted to selectively retain the writing implement in an axial location within the passage. In this way, the body can accommodate different writing implements of different lengths and/or writing implements such as wooden pencils whose length varies during the life thereof.

The retaining means may comprise resiliently biased means adapted to impinge on the side surface of the writing implement to retain same in the passage. For example, the retaining means may comprise an annular spring or the like having a gripping surface whereby insertion of the writing implement through the spring against its bias results in the gripping surface being urged into engagement with the side surface upon a desired position being reached.

Alternatively, the retaining means may comprise an assembled or integrally formed knurled member adapted to be biased toward the side wall of the writing implement in use. In the case of wooden pencils, the knurling may be directional in the manner of a ratchet whereby the pencil may be inserted from one end of the passage to extend with the writing point out of the other to the desired degree, but impingement of the knurling into the wood of the pencil prevents the pencil from sliding along the passage in use.

In a yet further alternative, the retaining means may comprise a split collet or the like formed integrally with or assembled to the body and adapted to cooperate with collet closing means for selectively closing the collet onto the side wall of the writing implement. For example the body member may be split from the writing point end of the passage to provide an integral collet. The collet closing means may comprise a tapered thread on the body or in a collet closing sleeve. Alternatively the outer surface of the body about the split may be tapered whereby the retaining of the pencil is by way of frictional engagement between an outer sleeve and the taper on the body.

The split may be singular or arranged in multiples. For example, the split may comprise a pair of slots on disposed symmetrically about the body. Alternatively, and especially in the case of hexagonal passages, the split may comprise 2 or 3 slots disposed along the centre of symmetrically selected flats of the hexagon.

The inner surface of the passage may be configured with a gripping surface to enhance the retaining ability of the collet arrangement.

The sleeve may be configured as a comfortable holding portion. Alternatively the comfortable holding portion may be integrally formed on the body or may be assembled to it. The comfortable holding portion may be of a resilient substance.

Alternatively, the retaining means may be in the form of a split plug formed separately from the body and removably engagable therewith. Typically, the plug is threadably engagable with the body.

Writing implements such as pencils and others having fixed points are inherently dangerous or likely to have the point damaged when not in use. For example, pencils in pockets may poke holes in clothing or injure the wearer. Accordingly, the apparatus is preferably configured whereby the point of the writing implement may be retracted Inside the passage when not in use. For example, the position of the retaining means may be such that the full diameter is retained thereby when the writing point is just within the passage, whilst retaining the pencil as close to the leading opening of the passage in use to enable the use of short stubs. Alternatively the body may be provided with an alternative retaining means for retaining the writing implement in its retracted position.

In a further embodiment the body may be provided with a sleeve that is adapted to be extended over the point of the writing implement when it is not in use. Alternatively, a separate cap for the writing point may be provided.

The body may be provided with other functionality, such as an annular eraser insert. For example there may be provided a groove about the body member whereby an eraser insert may be stretched over the body to engage the insert.

The body may be provided with a pocket clip or the like to enable a pencil to have the pocket-storage advantages of other writing implements so equipped. The body may for example have an integrally formed or assembled pocket clip. In one embodiment the pocket clip is relatively broad and is provided with a magnetized strip whereby the apparatus may be supported on a steel surface thereby such as a refrigerator cabinet, such that the apparatus is available for shopping lists and the like. Such embodiments are particularly advantageous where the apparatus is adapted for use with score card pencils, for example for scoring golf rounds.

According to a further broad form of the invention there is provided a writing assembly including an accessory of the first broad form having a writing implement retained thereby.

DETAILED DESCRIPTION

Figure 1:
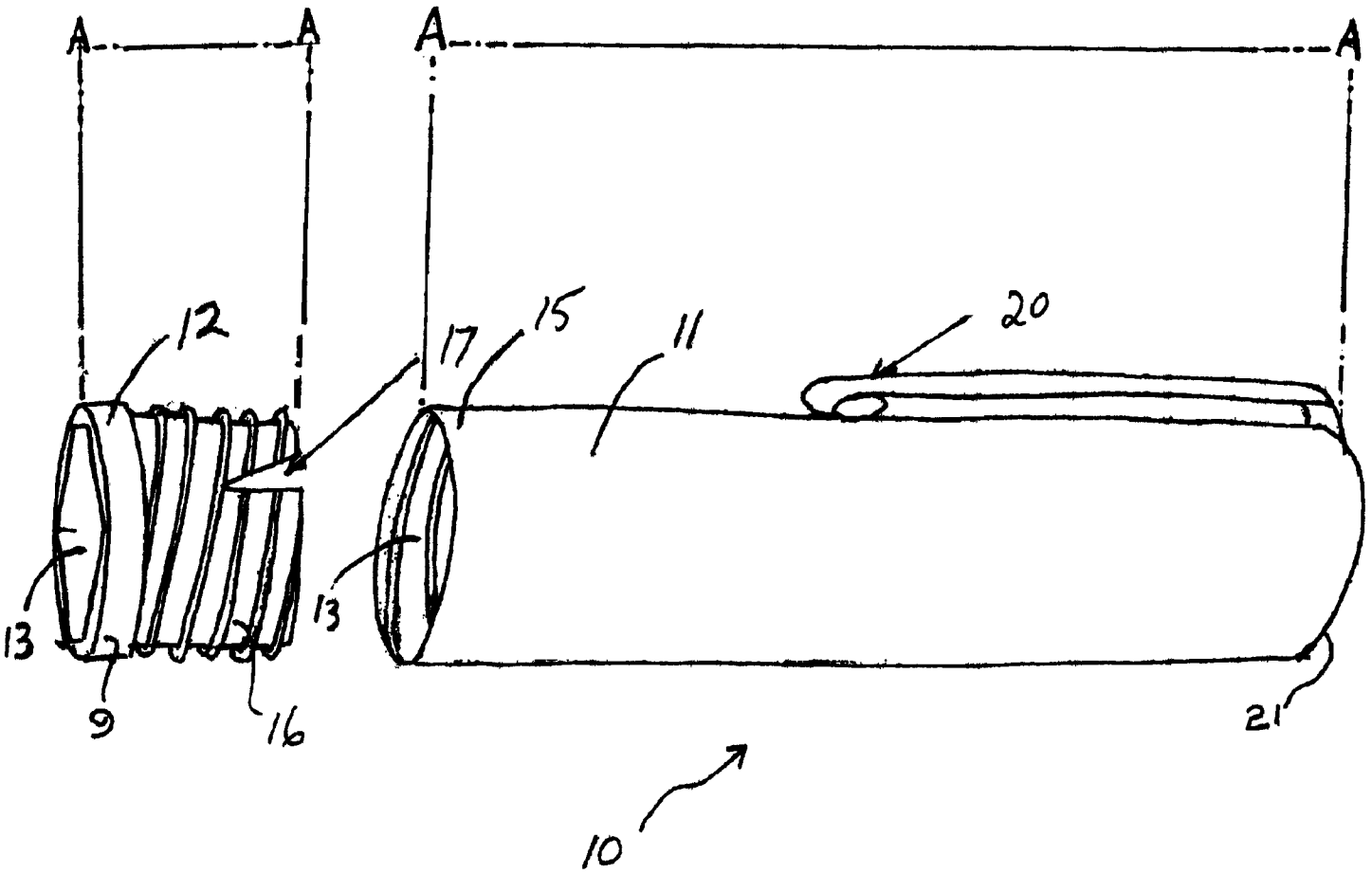
FIG. 1 is an exploded perspective view of a preferred accessory in accordance with the present invention.
Figure 2:
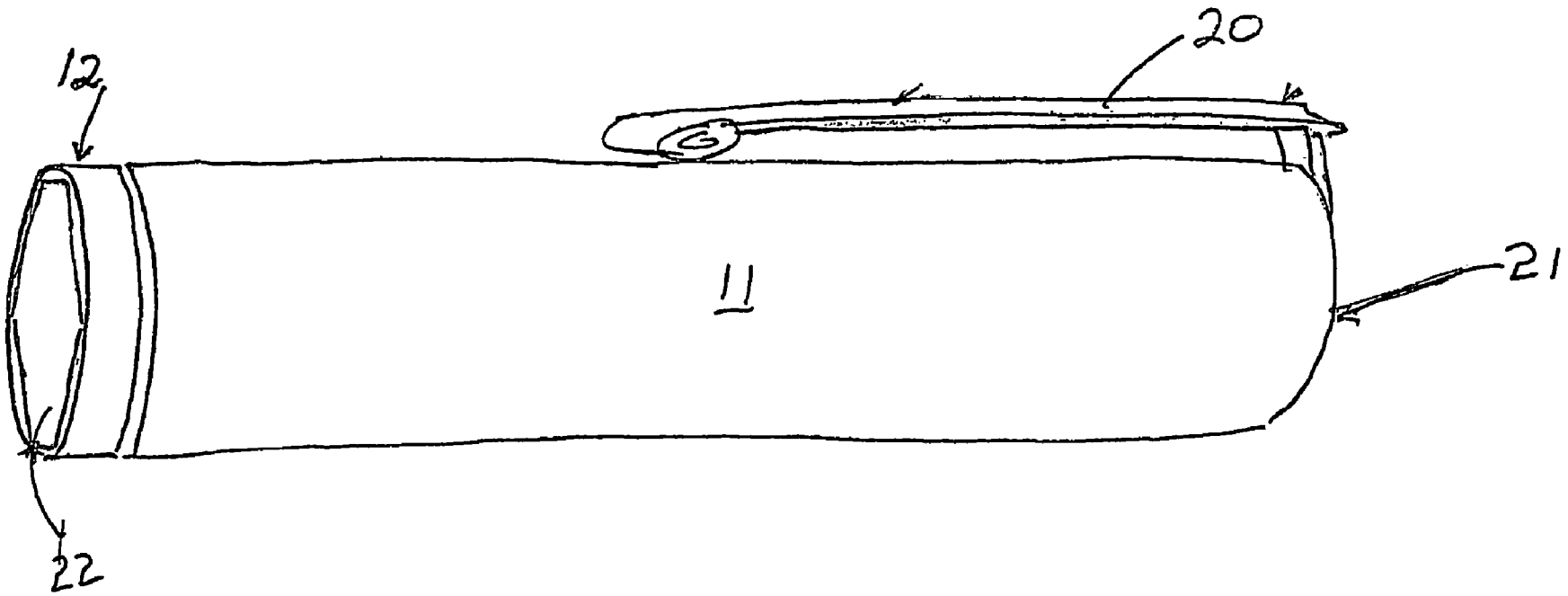
FIG. 2 is an assembled perspective view of the accessory of FIG. 1.
Figure 3:
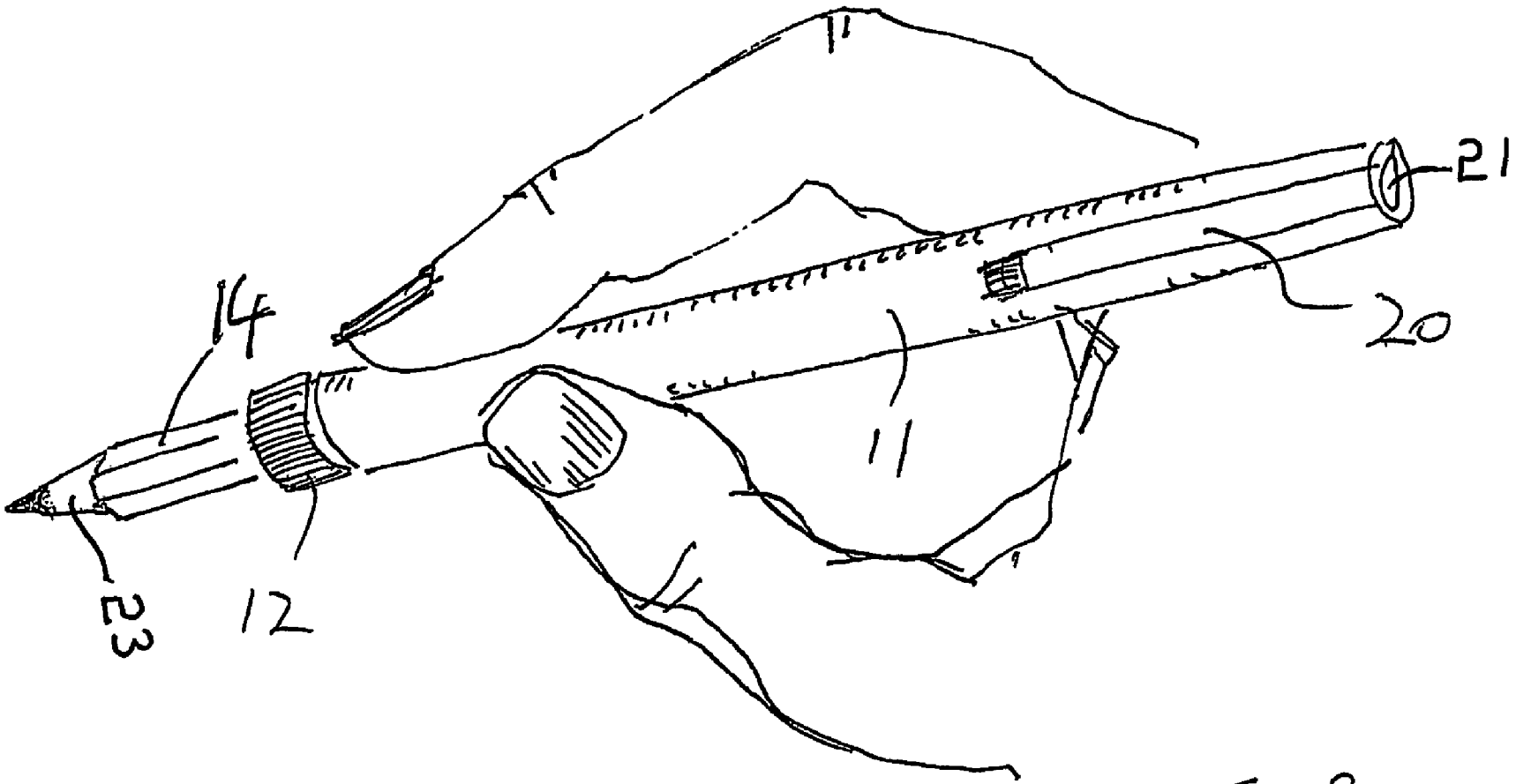
FIG. 3 is a perspective view of a preferred assembly of the present invention in use.

FIG. 1 is an exploded view of an accessory 10 of the present invention. The accessory 10 includes a body assembly comprising a barrel 11 and a split plug 12. The body assembly defines a passage 13 which in use is adapted to receive a pencil 14, as shown in FIG. 3. The barrel is provided with an internally threaded end 15. The split ring 12 has an externally threaded end 16. Thread 15 is defined integrally with the barrel and is adapted to threadably engage thread 16 of the split plug 12. The split plug 12 is provided with a pair of opposed slots 17 forming splits in the plug at the portion thereof where the external thread is defined. The respective threaded portions 15, 16 are relatively tapered whereby threaded engagement of the split ring 12 with the barrel 11 causes slots 17 to close up, thereby reducing the cross section of the passage 13 at the split plug. In this way, a pencil held within passage 13 may be retained thereby.

Figure 5:
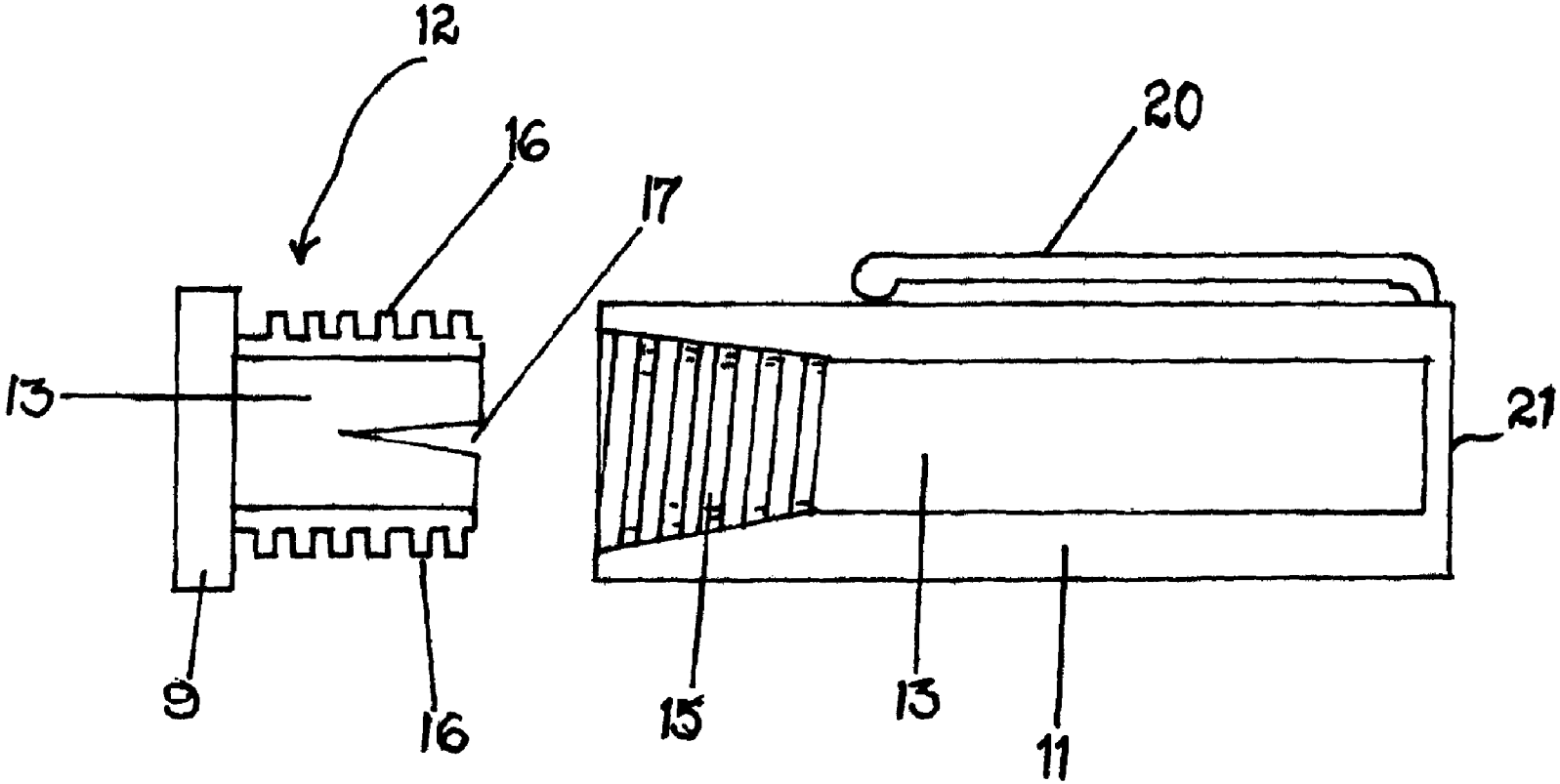
FIG. 5 is a side sectional view of accessory.

FIG. 5 shows a side sectional view of accessory taken along line A-A and shows internally threaded portion 15 of the tubular body 11 tapered relative to externally threaded portion 16 of retaining means, the taper of the internal thread widening toward the open end of the tubular body.

Figure 6:
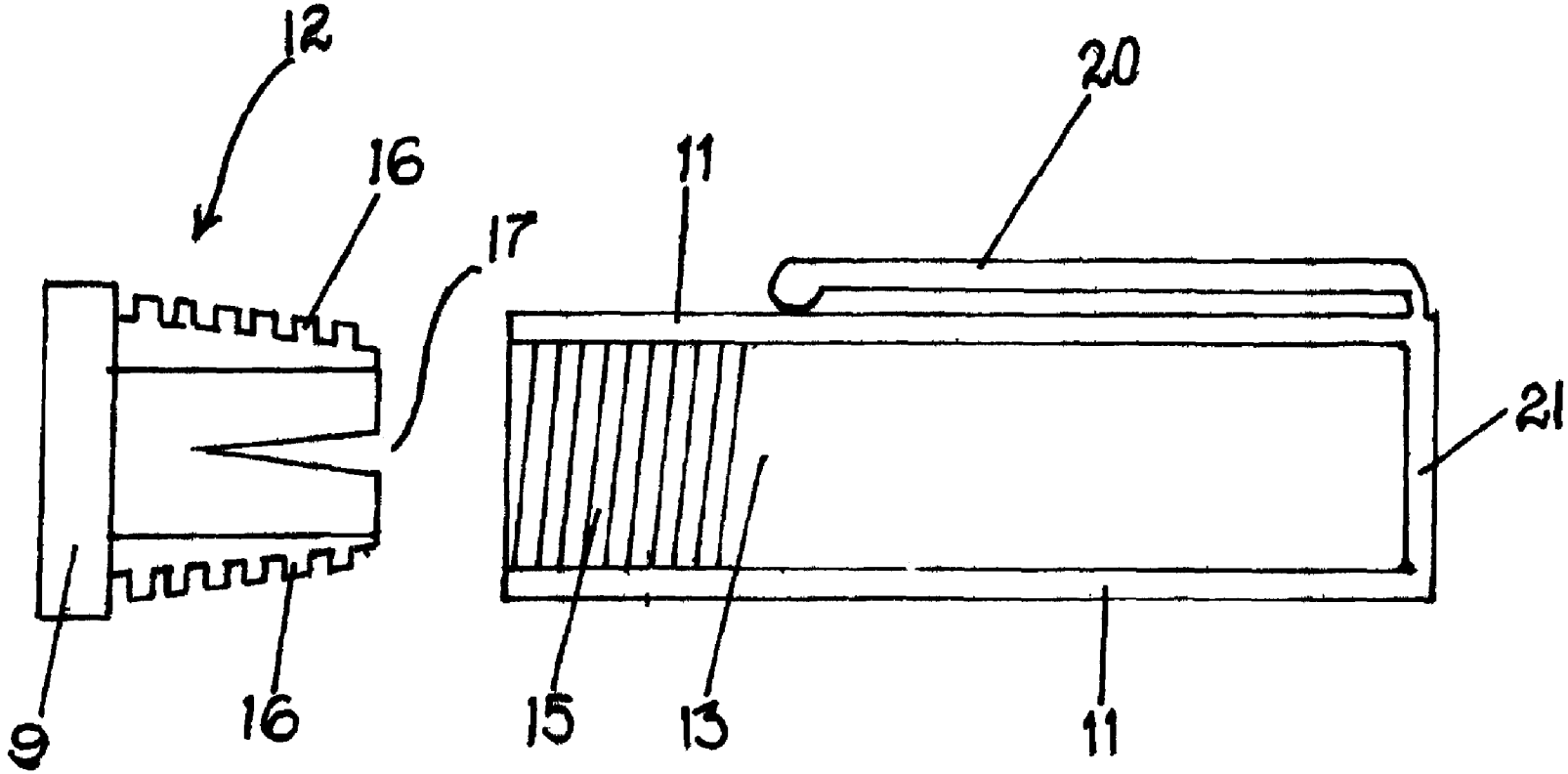
FIG. 6 is a side sectional view of accessory.

FIG. 6 shows a side sectional view of accessory and shows externally threaded portion 16 of retaining means 12 tapered relative to internally threaded portion 15 of tubular body 11, the taper of the external thread narrowing in a direction moving into the tubular body through the open end thereof during engagement of the threads.

Figure 7:
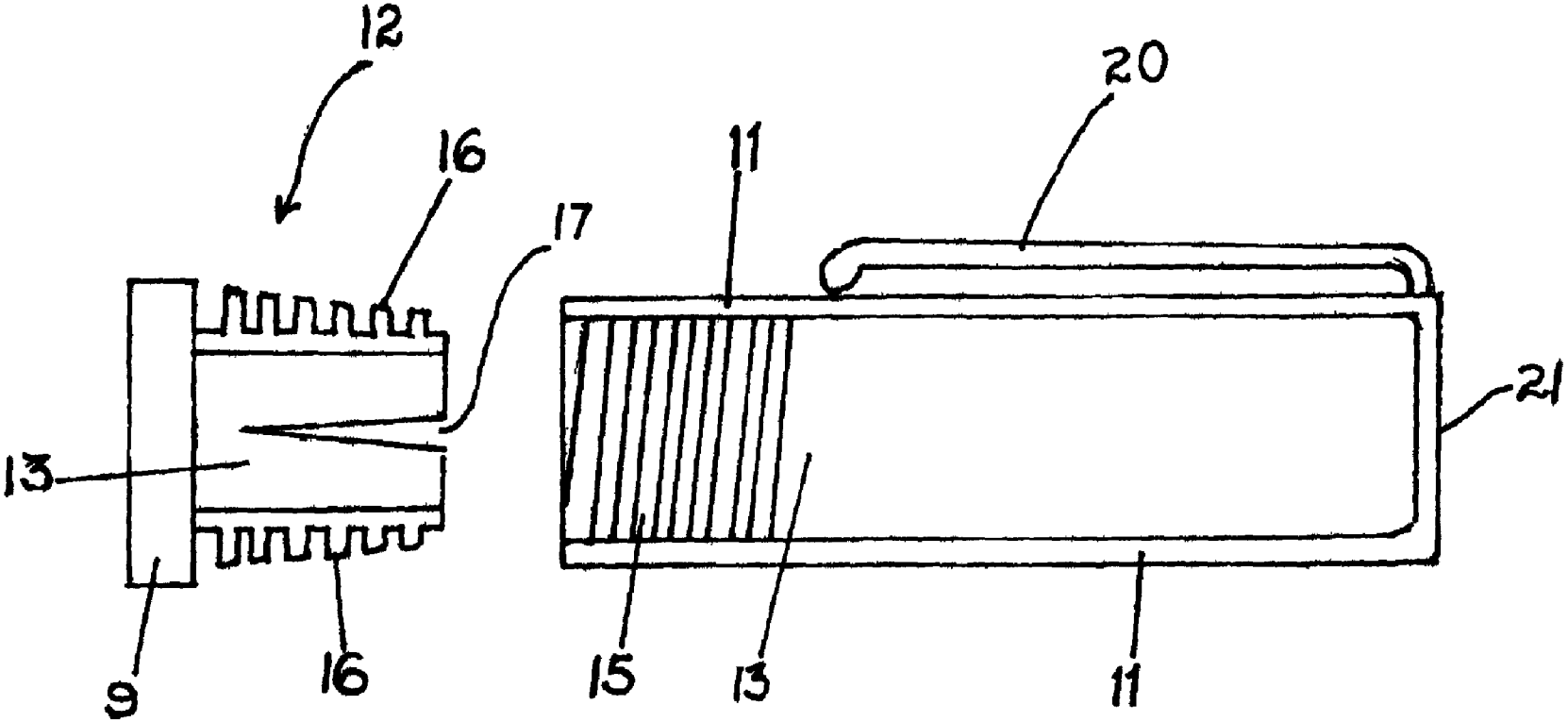
FIG. 7 is a side sectional view of accessory.

FIG. 7 shows a side sectional view of accessory and shows externally threaded portion 16 of retaining means 12 tapered relative to internally threaded portion 15 of tubular body 11.

The barrel is provided with a pocket clip 20. In this embodiment the barrel is made blind by closed end portion 21 of the barrel 11.

FIG. 12 shows the split plug 12 threadably engaged with the barrel 11

Figure 4:
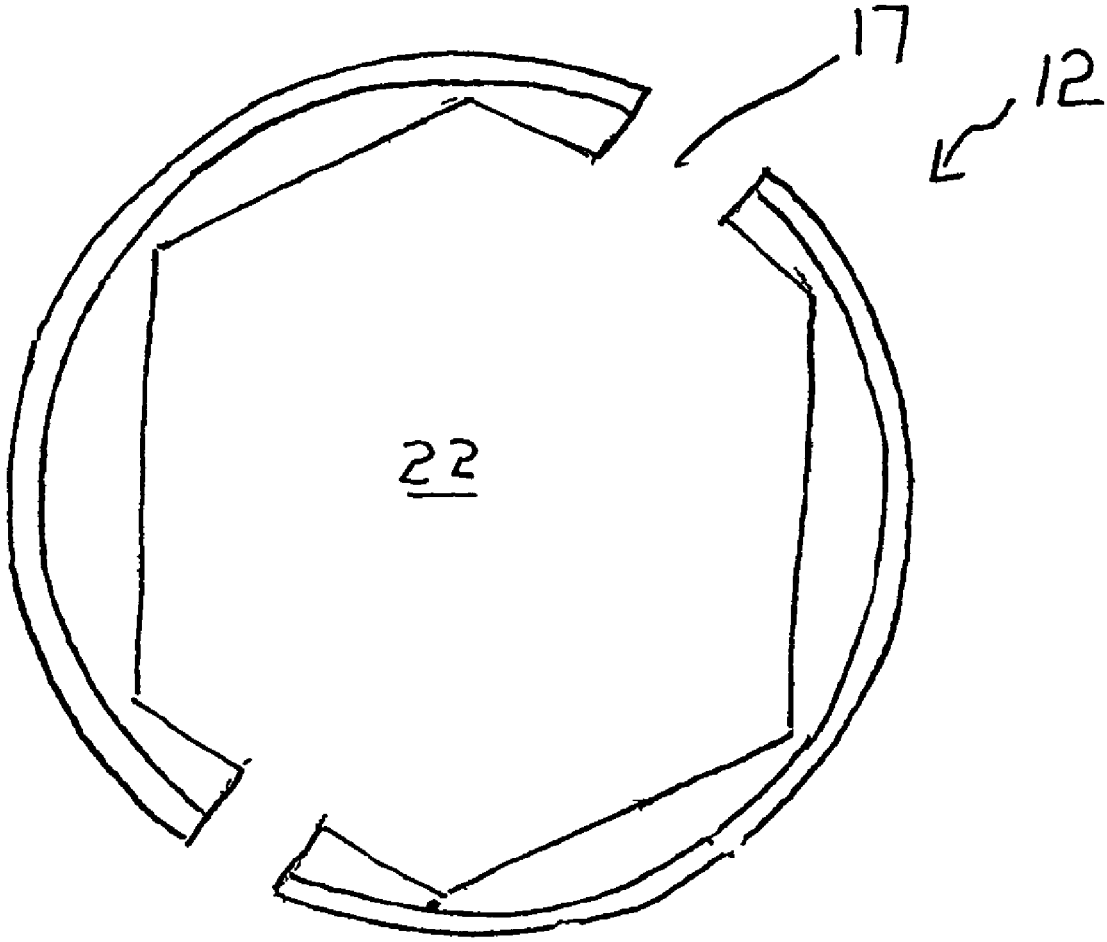
FIG. 4 is and end view of the split plug of the accessory of FIG. 1.

In use, the split plug 12 may be loosened or removed from the barrel 11. A pencil 14 may be inserted but-end first through the opening 22 of the split plug 12. In this embodiment, the opening is hexagonal so as to accommodate a pencil of hexagonal cross section. (The hexagonal cross section may be more clearly seen in FIG. 4) The pencil is inserted though the split plug 12 to the extent required for use. The split plug 12 and pencil are then threadably engaged with the barrel 11 and tightened to retain the pencil 14. The writing assembly incorporating pencil 14 and accessory 10 is shown in FIG. 4. In FIG. 4, the outer surface of the split ring 12 is textured so as to facilitate a user's grip when tightening.

When it is desired to sharpen the pencil, the split ring 12 may be loosened by partially unscrewing the split plug 12 from the barrel 11. When loosened, the pencil 14 can be gripped about the writing end 23 and be withdrawn from the barrel.

The accessory may also be provided with a separate pencil point cover (not shown) which can protect the pencil point when not in use. Typically, the cover is engagable with the barrel 11.

It can be seen that the accessory of the present invention can be used to retain a writing implement such as a pencil in a firm and efficient manner. The accessory may be used with pencils of virtually any length and allows the use of shortened pencils or pencil stubs which under normal circumstances would be discarded. This can significantly extend the life of a pencil. Further the accessory provides means of attaching a pencil to a user's clothing or other suitable surface. This may reduce the likelihood of pencils being misplaced. Still further, the accessory can provide a means of covering the point of a pencil or the like. This can avoid inadvertent damage or breaking of the pencil tip and may also protect cloths or the like from being damaged or marked by the writing tip of a writing implement. The accessory may be re-used any number of times.

In the present specification and claims, the term "comprising" and related terms "comprises" and "comprise" are used inclusively and include the stated integer or integer together with any unstated integer or integers.

It will of course be realised that while the above has been given by way of illustrative example of this invention, all such and other modifications and variations thereto as would be apparent to persons skilled in the art are deemed to fall within the broad scope and ambit of this invention as is herein set forth.

The invention claimed is:

1. An accessory for a writing implement, the accessory comprising:

a retaining means comprising a sleeve having an internal passage to accept axial insertion of the writing implement, an external thread defined on at least a portion of the sleeve and at least one split in the sleeve at the portion thereof where the external thread is defined; and a tubular body comprising an open end having an internal thread integrally defined with the tubular body for engagement with the external thread of the retaining means;

said internal thread of the tubular body having a taper relative to the external thread of the retaining means, the taper widening toward the open end of the tubular body;

wherein threadably engaging the retaining means with the tubular body through the open end thereof tightens the retaining means against the writing implement and thereby retains the writing implement in the retaining means.

2. The accessory of claim 1, in which the writing implement is a pencil.

3. The accessory of claim 1, in which the writing implement is a scribe.

4. The accessory of claim 1, in which the writing implement is a pen.

5. An accessory for a writing implement, the accessory comprising:

a tubular body comprising an open end having an internal thread integrally defined with the tubular body;

a retaining means comprising a sleeve having an internal passage to accept axial insertion of the writing implement, an external thread defined on at least a portion of the sleeve for engagement with the internal thread of the tubular body and at least one split in the sleeve at the portion thereof where the external thread is defined;

said external thread of the retaining means having a taper relative to the internal thread of the tubular body and being arranged such that the taper narrows in a direction moving into the tubular body through the open end thereof during engagement of the threads;

wherein threadably engaging the retaining means with the tubular body through the open end thereof tightens the retaining means against the writing implement, thereby retaining the writing implement in the retaining means.

6. The accessory of claim 5, in which the writing implement is a pencil.

7. The accessory of claim 5, in which the writing implement is a scribe.

8. The accessory of claim 5, in which the writing implement is a pen.

* * * * *